US012674271B2

(12) United States Patent
Yoon et al.

(10) Patent No.: US 12,674,271 B2
(45) Date of Patent: Jul. 7, 2026

(54) LAUNDRY TREATING APPARATUS

(71) Applicant: LG Electronics Inc., Seoul (KR)

(72) Inventors: Juhan Yoon, Seoul (KR); Myoungjong Kim, Seoul (KR); Matthias Herrmann, Seoul (KR)

(73) Assignee: LG Electronics Inc., Seoul (KR)

( * ) Notice: Subject to any disclaimer, the term of this patent is extended or adjusted under 35 U.S.C. 154(b) by 729 days.

(21) Appl. No.: 18/018,479

(22) PCT Filed: Jul. 26, 2021

(86) PCT No.: PCT/KR2021/009611
§ 371 (c)(1),
(2) Date: Jan. 27, 2023

(87) PCT Pub. No.: WO2022/025548
PCT Pub. Date: Feb. 3, 2022

(65) Prior Publication Data

US 2023/0287621 A1 Sep. 14, 2023

(30) Foreign Application Priority Data

Jul. 29, 2020 (KR) ..... 10-2020-0094416

(51) Int. Cl.
*F28G 3/02* (2006.01)
*D06F 58/10* (2006.01)
(Continued)

(52) U.S. Cl.
CPC ..... *D06F 58/22* (2013.01); *D06F 58/10* (2013.01); *D06F 58/206* (2013.01); *D06F 58/24* (2013.01)

(58) Field of Classification Search
CPC ..... D06F 58/22; D06F 58/10; D06F 58/206; D06F 58/24; D06F 58/20; F28G 1/00; F28G 1/02
See application file for complete search history.

(56) References Cited

U.S. PATENT DOCUMENTS 8,266,815 B2 * 9/2012 Goldberg ..... D06F 58/24 15/88.4
9,593,895 B2 * 3/2017 Kim ..... A46B 13/026
(Continued)

FOREIGN PATENT DOCUMENTS

CN 101563495 A 10/2009
CN 103774401 A 5/2014
(Continued)

OTHER PUBLICATIONS

Notice of Allowance in Korean Appln. No. 10-2020-0094416, mailed on May 7, 2025, 3 pages (with English translation).
(Continued)

*Primary Examiner* — Deming Wan
(74) *Attorney, Agent, or Firm* — Fish & Richardson P.C.

(57) ABSTRACT

A laundry treating apparatus includes a cabinet, a drum, a circulating flow passage configured to supply air discharged from the drum into the drum, a fan disposed inside the circulating flow passage and configured to cause the air to flow along the circulation flow passage, an evaporator disposed inside the circulating flow passage and configured to cool the air discharged from the drum, a condenser spaced apart from the evaporator and configured to heat the air, and a removal device that separates foreign matters from a heat exchanger including the condenser and the evaporator. The removal device is configured to provide a mechanical force for separating the foreign matters from the heat exchanger.

20 Claims, 9 Drawing Sheets

(51) Int. Cl.

| | |
|---|---|
| ***D06F 58/20*** | (2006.01) |
| ***D06F 58/22*** | (2006.01) |
| ***D06F 58/24*** | (2006.01) |
| ***F28G 1/00*** | (2006.01) |
| ***F28G 1/02*** | (2006.01) |
| ***F28G 1/08*** | (2006.01) |
| ***F28G 3/10*** | (2006.01) |
| ***F28G 3/12*** | (2006.01) |

(56) References Cited

U.S. PATENT DOCUMENTS

| | | | | |
|---|---|---|---|---|
| 10,605,546 | B2 * | 3/2020 | Yajima | F24F 11/41 |
| 2010/0146812 | A1 | 6/2010 | Ahn et al. | |
| 2014/0109427 | A1 * | 4/2014 | Kim | D06F 58/206 34/85 |
| 2014/0165417 | A1 | 6/2014 | Ahn et al. | |
| 2014/0182155 | A1 | 7/2014 | Kim et al. | |
| 2014/0250710 | A1 | 9/2014 | Yang et al. | |
| 2018/0044845 | A1 | 2/2018 | Bocchino | |
| 2018/0171537 | A1 | 6/2018 | Lee et al. | |
| 2019/0024299 | A1 | 1/2019 | Ryu | |

FOREIGN PATENT DOCUMENTS

| | | | |
|---|---|---|---|
| DE | 10-2006-007442 | A1 | 8/2007 |
| DE | 10-2007-016074 | A1 | 10/2008 |
| EP | 0468573 | A1 | 1/1992 |
| EP | 2620539 | A1 | 7/2013 |
| EP | 2628846 | A1 | 8/2013 |
| KR | 10-2003-0084070 | A | 11/2003 |
| KR | 10-2009-0028027 | A | 3/2009 |
| KR | 10-2011-0123344 | A | 11/2011 |
| KR | 10-2012-0110497 | A | 10/2012 |
| KR | 10-2012-0110502 | A | 10/2012 |
| KR | 10-2014-0087555 | A | 7/2014 |
| KR | 10-2016-0149593 | A | 12/2016 |
| WO | 2011/139097 | A2 | 11/2011 |

OTHER PUBLICATIONS

Office Action in Chinese Appln. No. 202180058277.8, mailed on May 20, 2025, 15 pages (with English translation).

Extended European Search Report in European Appln. No. 21849770.9, mailed on Jul. 4, 2024, 10 pages.

Office Action in Korean Appln. No. 10-2020-0094416, mailed on Dec. 14, 2024, 7 pages (with English translation).

International Search Report and Written Opinion in International Appln. No. PCT/KR2021/009611, mailed on Nov. 9, 2021, 8 pages (with English translation).

* cited by examiner (a)

(b)

(a)

(b)

LAUNDRY TREATING APPARATUS

CROSS-REFERENCE TO RELATED APPLICATIONS

This application is a National Stage application under 35 U.S.C. § 371 of International Application No. PCT/KR2021/009611, filed on Jul. 26, 2021, which claims the benefit of Korean Patent Application No. 10-2020-0094416, filed on Jul. 29, 2020. The disclosures of the prior applications are incorporated by reference in their entirety.

TECHNICAL FIELD

The present disclosure relates to a laundry treating apparatus.

BACKGROUND

A laundry treating apparatus performs a drying process for removing moisture from laundry. For example, the laundry treating apparatus may drastically shorten a drying time of the laundry by supplying hot air to a drum accommodating the laundry therein, and sterilize and disinfect the laundry.

In some cases, the laundry treating apparatus may use an electric heater to supply hot air to the drum. A healer installed on the duct in communication with the drum may generate hot air by heating air flowed into the drum.

In some cases, a laundry treating apparatus heats air flowed into the drum with a heat pump system. In some cases, the laundry treating apparatus may condense moisture by cooling air discharged from the laundry through an evaporator, and re-heat the air through a condenser to generate hot air that has a high temperature and is dry.

The laundry treating apparatus having the heat pump system had advantages in that energy efficiency is higher than that of the laundry treating apparatus using the electric heater, installation is simple, and repair and replacement are easy.

However, in some cases, foreign matters such as lint and the like are attached to the evaporator because air discharged from the laundry directly collides with the evaporator. In some cases, the foreign matters attached to the evaporator may interfere with heat exchange between a cold refrigerant flowing through the evaporator and air discharged from the drum, thereby reducing a drying efficiency.

In particular, when the foreign matters remaining in the evaporator are corrupted by bacteria and the like, the laundry accommodated in the drum may be contaminated.

In some cases, a laundry treating apparatus may wash the evaporator with water.

For example, the laundry treating apparatus may automatically remove the foreign matters attached to the evaporator by supplying water to the evaporator, where users do not have to directly wash the evaporator.

FIG. 1 shows an evaporator of a laundry treating apparatus in related art.

An evaporator 41 of the laundry treating apparatus may include a plurality of heat exchange fins P, a refrigerant pipe disposed to pass through the heat exchange fins P, a fixing member P1 that fixes the heat exchange fins P, and a water inlet 35 that is defined in a top surface of the evaporator 41 and is able to supply water to the heat exchange fins P or the fixing member P1.

When air discharged from the drum flows into the heat exchange fins P, the air may be cooled and condensed through heat exchange with the refrigerant. However, because air discharged from the drum contains the foreign matters such as the lint and the like, the foreign matters may not pass through the heat exchange fins P, and may be attached to an inflow surface of the evaporator.

In some cases, when water is supplied to the water inlet 35, the water flows along the heat exchange fins P, so that the foreign matters may be removed. However, a pressure of water sprayed to a washing nozzle may not be high, and the sprayed water may not be supplied to an entirety of the inflow surface of the evaporator 41.

In addition, the water sprayed from the water inlet 35 may not provide a force to directly separate the foreign matters from the evaporator except for pushing the foreign matters.

As a result, even when the laundry treating apparatus has the structure of washing the evaporator with water, the foreign matters attached to a surface of the evaporator may remain even after the water spray.

In some cases, when the foreign matters are firmly attached to the surface of the evaporator, such as tightly entangled, the foreign matters may not be removed.

SUMMARY

The present disclosure describes a laundry treating apparatus in which an apparatus that separates foreign matters attached to a surface of an evaporator is installed.

The present disclosure further describes a laundry treating apparatus capable of providing a mechanical force for separating foreign matters from an evaporator.

The present disclosure further describes a laundry treating apparatus in which an apparatus that may be detachably coupled to an evaporator and may separate foreign matters attached to the evaporator is installed.

The present disclosure further describes a laundry treating apparatus in which an apparatus that separates foreign matters of an evaporator may be coupled to the evaporator again when completing the separation of the foreign matters.

The present disclosure further describes a laundry treating apparatus in which an apparatus that separates foreign matters from an evaporator may be automatically controlled.

According to one aspect of the subject matter described in this application, a laundry treating apparatus includes a cabinet that defines an outer appearance of the laundry treating apparatus, a drum accommodated in the cabinet and configured to receive laundry therein, a circulating flow passage configured to supply air discharged from the drum into the drum, a fan disposed inside the circulating flow passage and configured to cause the air to flow along the circulation flow passage, a heat-exchanger including (i) an evaporator disposed inside the circulating flow passage and configured to cool the air discharged from the drum and (ii) a condenser spaced apart from the evaporator and configured to heat the air in the circulating flow passage, and a removal device coupled to the evaporator or the condenser, the removal device being configured to move relative to the heat exchanger to thereby separate foreign matters from the evaporator or the condenser.

Implementations according to this aspect can include one or more of the following features. For example, the removal device includes a separating body disposed at one surface of the evaporator or the condenser and a driver configured to move the separating body toward and away from the circulating flow passage, in some examples, the separating body can be disposed at a surface of the evaporator facing an upstream side of the circulating flow passage. In some examples, the evaporator can be configured to contact the air guided by the circulating flow passage before the condenser contacts the air, where the separating body is disposed at a surface of the evaporator.

In some implementations, the removal device can further include a pivoting portion that is coupled to the separating body and pivotably supports the separating body, where the driver is configured to provide power to the pivoting portion. In some examples, the removal device can further include a seated portion spaced apart from the pivoting portion and coupled to the separating body, where the driver is coupled to the seated portion and configured to push or pull the seated portion.

In some implementations, the laundry treating apparatus can further include a washer configured to supply water to the surface of the evaporator to thereby remove the foreign matters from the evaporator, where the driver is configured to receive the water from the washer and to push the seated portion by the water. In some examples, the seated portion can be configured to remove the foreign matters by the water that is received from the driver and transferred to the separating body or the surface of the evaporator. In some examples, the seated portion can include an inflow body coupled to the driver and configured to receive water from the driver, and a seated body coupled to the separating body and configured to supply the water from the inflow body to the separating body or the surface of the evaporator.

In some implementations, the driver can include an elastic pipe that fluidly communicates the washer and the inflow body with each other, where the elastic pipe is configured to push the inflow body based on water being supplied from the washer, and to pull the inflow body based on water supply from the washer being stopped. In some examples, the driver can include a mounting duct fixed to the evaporator, a suction pipe that extends from the mounting duct and is coupled to the washer, and an extended pipe that is disposed inside the mounting duct and in fluid communication with the suction pipe, where the extended pipe is coupled to the elastic pipe.

In some implementations, the pivoting portion can include a pivoting body coupled to an end of the separating body and a pivoting link that pivotably supports the pivoting body on the surface of the evaporator or the circulating flow passage. For example, the pivoting body can include a body holder coupled to the separating body and a holder support disposed at the body holder and configured to limit a pivoting angle of the separating body.

In some implementations, the pivoting portion can be coupled to a first end of the separating body, where the seated portion is disposed at a second end of the separating body. In some examples, the pivoting portion is one of a plurality of pivoting portions that are disposed along the surface of the evaporator, where the driver is configured to sequentially rotate the plurality of pivoting portions.

In some implementations, the removal device can be coupled to the evaporator and configured to move relative to the evaporator to separate the foreign matters from the evaporator. In some examples, the removal device is configured to rotate relative to the evaporator. In some examples, the removal device is configured to linearly move relative to the evaporator.

In some implementations, the removal device can be coupled to the condenser and configured to move relative to the condenser to separate the foreign matters from the condenser. For example, the removal device can be configured to rotate relative to the condenser or linearly move relative to the condenser.

In some implementations, the removal device separates the foreign matters attached to the surface of the evaporator. The removal device can provide the mechanical force for separating the foreign matters from the evaporator. The removal device can be detachably coupled to the evaporator for separating the foreign matters attached to the evaporator. The removal device can separate the foreign matters of the evaporator and be coupled to the evaporator again when completing the separation of the foreign matters to restore a position thereof. The removal device, which separates the foreign matters from the evaporator, can be automatically controlled.

DETAILED DESCRIPTION

Figure 1:
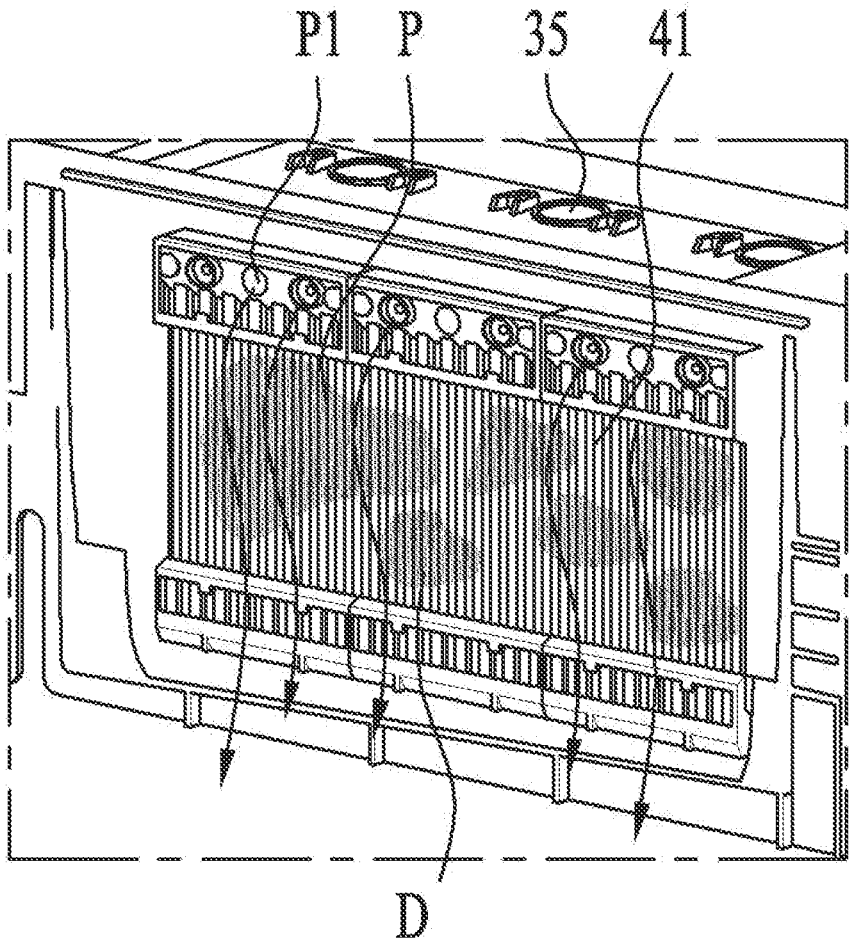
FIG. 1 RELATED ART
FIG. 1 shows an evaporator structure of a laundry treating apparatus in related art.

Hereinafter, implementations disclosed herein will be described in detail with reference to the accompanying drawings. In this specification, the same and similar reference numerals are assigned to the same and similar components even in different implementations, and the description thereof is replaced by the first description. As used herein, the singular expression includes the plural expression unless the context clearly dictates otherwise. In addition, in describing the implementations disclosed herein, when it is determined that a detailed description of a related known technology may obscure the gist of the implementations disclosed in the present specification, the detailed description thereof will be omitted. In addition, the accompanying drawings are only for easy understanding of the implementations disclosed in the present specification, and it should be noted that the technical idea disclosed herein should not be construed as being limited by the accompanying drawings.

Figure 2:
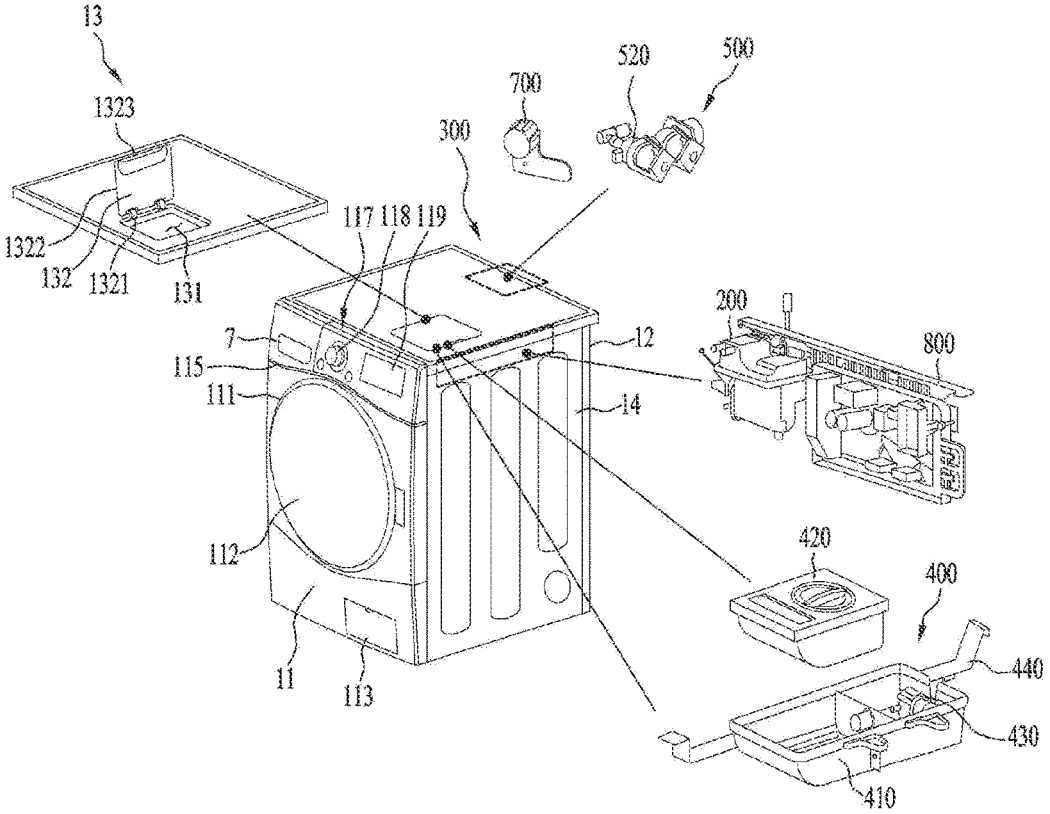
FIG. 2 shows an example of a laundry treating apparatus.

FIG. 2 shows example features of a laundry treating apparatus of the present disclosure.

In some implementations, as shown in FIG. 2, a cabinet 1 includes a front panel 11 defining a front surface of the laundry treating apparatus. The front panel 11 has an inlet 111 defined therein to communicate with a drum 2 and a door 112 pivotally coupled to the cabinet open and close the inlet 111.

A control panel 117 is disposed on the front panel 11. The control pane 117 may include an input unit 118 for receiving a control command from a user, and a display 119 for outputting information such as a control command selectable by the user. A main controller that controls a command for performing a drying process of the laundry treating apparatus may be installed.

The input unit 118 may be configured to include a power supply request unit for requesting power supply to the laundry treating apparatus, a course input unit for allowing the user to select a desired course among a plurality of courses, and an execution request unit for requesting start of a course selected by the user. The display 119 may be configured to include at least one of a display panel capable of outputting a text and a figure, and a speaker capable of outputting an audio signal and a sound.

In one example, the laundry treating apparatus may include a water storage 7 configured to separately store therein moisture generated in the process of drying the laundry. The water storage 7 may include a storage body 72 configured to be withdrawn from one side of the front panel 11 to the outside. The storage body 72 may be configured to collect condensate delivered from a washing pump to be described later. The user may withdraw the storage body 72 from the cabinet 1 to remove the condensate therefrom, and then, mount the storage body 72 in the cabinet 1 again. Therefore, the laundry treating apparatus may be placed in any places where a sewer or the like is not installed.

In one example, the laundry treating apparatus may further include a steam supplier 200 capable of supplying steam to the laundry or into the cabinet. The steam supplier 200 may be configured to generate the steam by receiving fresh water rather than the condensate. The steam supplier 200 may be configured to generate the steam by heating the water, using ultrasonic waves, or vaporizing the water.

Because the steam supplier 200 is configured to generate the steam by receiving a certain amount of water, the steam supplier 200 may occupy a certain volume. In this connection, the door and the control panel 117 are installed on the front panel 11 of the cabinet, and a duct that supplies or discharges air to/from the drum, a water supply, and the like may be installed on the rear panel 12 of the cabinet, so that the steam supplier 200 may be advantageously installed on the side panel 14 of the cabinet.

In addition, the laundry treating apparatus may include a steam controller 800 configured to separately control the steam supplier 200. The steam controller 800 may be installed on the control panel 117, hut may be configured as a separate control panel to prevent overloading of the control panel 117 and to prevent increase a production cost.

The steam controller 800 may be disposed adjacent to the steam supplier 200. The steam controller 800 may be disposed on the side panel 14 on which the steam supplier 200 is installed to reduce a length of a control line or the like connected to the steam supplier 200.

In some examples, where the steam supplier 200 supplies the steam that may contact the laundry, fresh water can be used to generate the steam. Because the water collected in the water storage 7 is generated from the laundry, there is a high possibility that lint or foreign matters are contained in the water collected in the water storage 7. Thus, the water collected in the water storage 7 may not be suitable for generating the steam.

Accordingly, the laundry treating apparatus may supply the water to the steam supplier 200, but may include a water supplier 300 configured separately from the water storage 7. The water supplier 300 may be configured to store the fresh water therein, or receive the fresh water from the outside and supply the fresh water to the steam supplier 200.

For example, the water supplier 300 may include an external water supplier 500 that may receive water from an external water supply source and deliver the water to the steam supplier 200, and an internal water supplier 400 that may separately store the fresh water therein and supply the fresh water to the steam supplier 200.

The internal water supplier 400 may further include a water tank 420 that is configured separately from the water storage 7 to store the fresh water therein, a water pump 430 configured to supply the water in the water tank 420 to the steam supplier 200, and a tank housing 410 that seats the water tank 420 and the water pump 430 inside the cabinet.

The laundry treating apparatus may also be configured such that the water tank 420 and the steam supplier 200 are installed at different vertical levels, so that the water in the water tank 420 is supplied to the steam supplier 200 by a self-load.

In some examples, where the difference in the installation vertical level between the water tank 420 and the steam supplier 200 is not secured, the water pump 430 can be additionally installed. In addition, when the water pump 430 is additionally disposed, there is an advantage in that a space inside the cabinet 1 may be more densely utilized.

The external water supplier 500 may include a direct water valve 520 connected to the external water supply source to receive the water.

In addition, the laundry treating apparatus may further include a determination unit 700 that determines whether to supply the water to the steam supplier 200 by using which of the external water supplier 500 and the internal water supplier 400. The determination unit 700 may be structurally configured to determine which of the external water supplier 500 and the internal water supplier 400 is used.

In one example, the water tank 420 may be configured to store the fresh water therein. For example, the water tank 420 can be exposed to the outside of the cabinet 1 to be frequently filled with the fresh water.

However, because both the water tank 420 and the water storage 7 are configured to store the water therein, the user may be confused. For example, the laundry treating apparatus may be configured such that the water tank 420 and the water storage 7 are exposed from the cabinet in different directions and at different locations. For example, the water tank 420 may be configured to be exposed through the top panel 13, and the water storage 7 may be configured to be exposed through the front panel 11. Therefore, even when both the water tank 420 and the water storage 7 are arranged, the confusion of the user may be prevented.

The water tank 420 may have a relatively smaller volume than the water storage 7 because the water tank 420 must store the fresh water therein and a freshness of the stored water must be maintained. Accordingly, the user may distinguish the water tank 420 and the water storage 7 from each other by the volume difference.

Because the water tank 420 has the smaller volume than the water storage 7, the water tank 420 may be easily withdrawn upward. Accordingly, the water tank 420 may be configured to be withdrawn upward from the top panel 13. As a result, because the withdrawal directions of the water tank 420 and the water storage 7 are different from each other, the possibility of user confusion may be further reduced.

The top panel 13 of the laundry treating apparatus may include a tank withdrawal hole 131 defined therein configured such that the water tank 420 may be exposed to the outside or the water tank 420 may be withdrawn to the outside of the cabinet. The tank withdrawal hole 131 may have a cross-sectional area corresponding to or slightly larger than a cross-sectional area of the water tank 420.

The top panel 13 may further include a withdrawal cover 132 configured to shield the tank withdrawal hole 131 to prevent the water tank 420 from being arbitrarily withdrawn. The withdrawal cover 132 may include one or more panel coupling portions 1321 configured to be coupled to an outer peripheral surface of the tank withdrawal hole 131. The panel coupling portion 1321 may extend from one side of the withdrawal cover 132 so as to pivotably couple the withdrawal cover 132 to the top panel 13. The panel coupling portion 1321 and the top panel 13 may be coupled to each other in a hinge coupling scheme.

In one example, the withdrawal cover 132 may have a panel handle 1323 that may be gripped by the user on a surface thereof, and the panel handle 1323 may be defined as a groove that is concave downward from the withdrawal cover 132. In addition, the withdrawal cover 132 may further include a panel fixing portion 1332 detachably coupled to an outer peripheral surface of the top panel 13 or the tank withdrawal hole 131. The panel fixing portion 1332 may be coupled to the top panel 13 or the tank withdrawal hole 131 in a push button scheme.

The laundry treating apparatus may further include a filter capable of removing foreign matters from circulating air. The front panel 11 may have a filter mounting hole 113 defined therein through which the filter is withdrawn or inserted.

Figure 3:
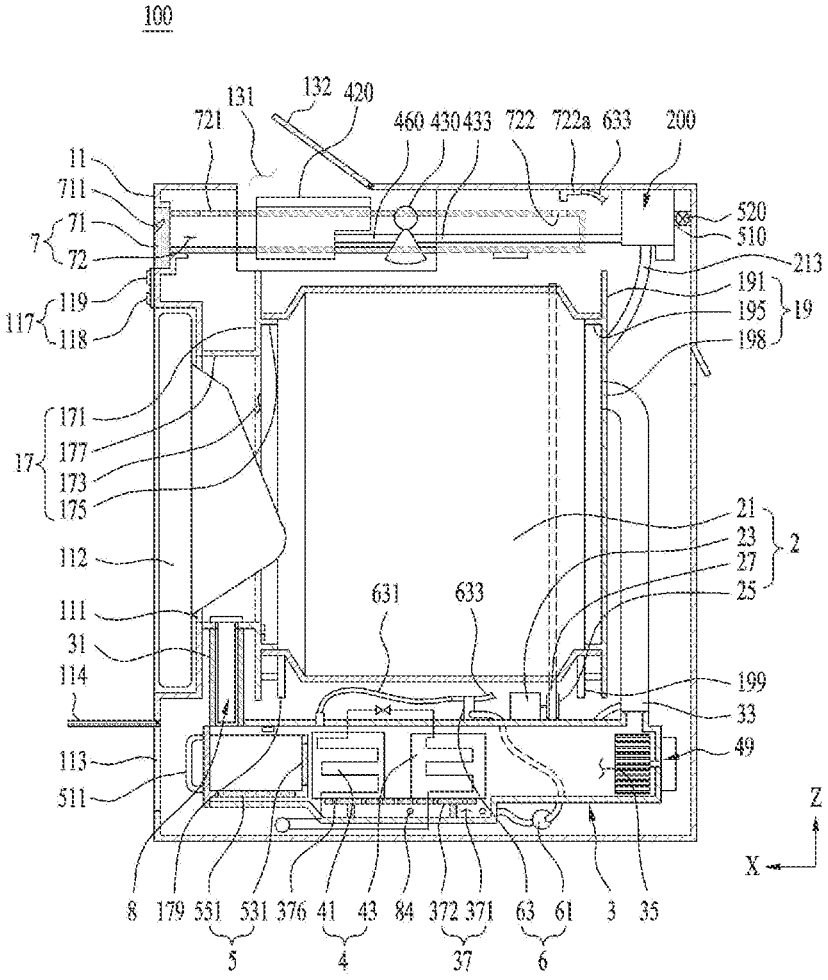
FIG. 3 shows an internal structure of the laundry treating apparatus.

FIG. 3 shows an internal configuration of a laundry treating apparatus of the present disclosure.

As shown in FIG. 3, the laundry treating apparatus 100 includes a cabinet 1, a drum 2 rotatably disposed inside the cabinet to define therein a space for storing the laundry therein, a duct 3 that defines a flow passage for re-supplying air discharged from the drum 2 to the drum 2, and a heat-exchanger 4 that dehumidifies and heats the air introduced into the duct 3 and then re-supplies the dehumidified and heated air to the drum 2.

When the drum 2 is configured as a cylindrical drum body 21 with an open front surface and an open rear surface, a first support 17 that rotatably supports the front surface of the drum 2 to be rotatable, and a second support 19 that supports the rear surface of the drum 2 to be rotatable may be arranged inside the cabinet 1.

The first support 17 may be configured to include a first fixed body 171 fixedly disposed inside the cabinet 1, a drum inlet 173 configured to extend through the first fixed body and communicating the inlet III and the inside of the drum body 21 with each other, and a first support body 175 disposed on the first fixed body 171 and inserted into the front surface (a first open surface) of the drum body 21.

The first fixed body 171 may have any shape as long as the drum inlet 173 may be defined therein and the first support body 175 may be disposed thereon. The first support body 175 may be formed in a pipe shape protruding from the first fixed body 171 toward the drum body 21. A diameter of the first support body 175 may be larger than a diameter of the drum inlet 173 and may be smaller than a front surface diameter of the drum body 21. In this case, the drum inlet 173 may be located inside a space defined by the first support body 175.

The first support 17 may be configured to further include a connection body 177 for connecting the inlet 111 and the drum inlet 173 with each other. The connection body 177 may be formed in a shape of a pipe extending from the drum inlet 173 to the inlet 111. The connection body 177 may have an air discharge hole 178 defined therein that communicates with a duct 3. As shown in FIG. 3, the air discharge hole 178 is a flow passage along which air inside the drum body 21 may flow to the circulating flow passage 3, which may be implemented as a through-hole configured to extend through the connection body 177.

The second support 19 may be configured to include a second fixed body 191 fixedly disposed inside the cabinet 1, and a second support body 195 disposed on the second fixed body 191 and inserted into the rear surface (a second open surface) of the drum body 21. An air inlet 198 is defined in the second support 19 and extends through the second fixed body 191 and communicates the inside of the drum body 21 with the inside of the cabinet 1. In this case, the duct 3 may be configured to connect the air discharge hole 178 and the air inlet 198 to each other.

The drum body 21 in a hollow cylindrical shape may be rotated by various types of drivers. FIG. 3 shows a case in which a driver 28 includes a motor 23 fixedly disposed inside the cabinet 1, a pulley 25 rotated by the motor, and a belt 27 connecting a circumferential surface of the pulley 25 and a circumferential surface of the drum body 21 with each other as an example.

In this case, the first support 17 may have a first roller 179 that supports a circumferential surface of the drum body 21 to be rotatable, and the second support 19 may have a second roller 199 that supports the circumferential surface of the drum body to be rotatable.

The duct 3 may define a circulating flow passage for circulating the air discharged from the drum and then re-supplying the circulated air to the drum.

The duct 3 may be configured to include an air discharge duct 31 connected to the air discharge hole 178, an air supply duct 33 connected to the air inlet 198, and a connection duct 35 connecting the air discharge duct and the air supply duct to each other.

The heat-exchanger 4 may be implemented as various devices as long as the devices may sequentially perform dehumidification and heating of the air introduced into the circulating flow passage 3. For example, the heat-exchanger 4 may be implemented as a heat pump system. The heat-exchanger 4 may include a fan 49 that flows air along the duct 3, a first heat-exchanger (heat-absorber) 41 that removes moisture from the air introduced into the duct 3, and a second heat-exchanger (heat-emitter) 43 which is disposed inside the duct 3 and heats the air that has passed through the first heat-exchanger 41.

Figure 4:
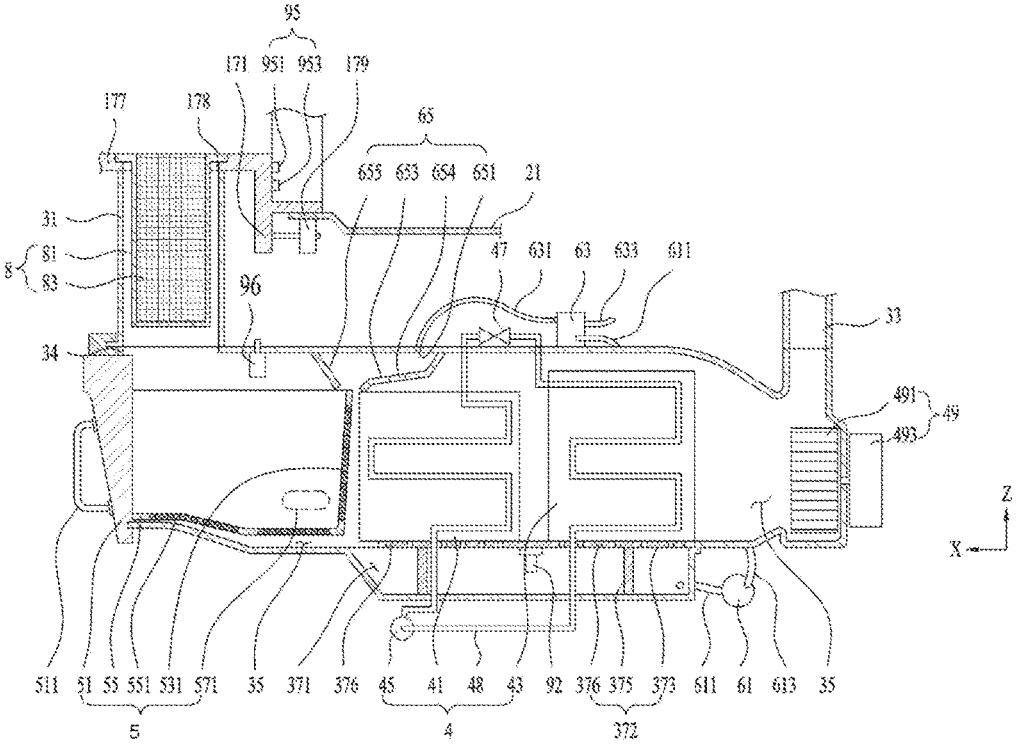
FIG. 4 shows an example of a condensate management structure of the laundry treating apparatus.

The fan 49 may be configured to include an impeller 491 disposed inside the duct 3 and an impeller motor 493 rotating the impeller 491 (see FIG. 4). The impeller 491 may be disposed anywhere in the air discharge duct 31, the connection duct 35, and the air supply duct 33. FIG. 3 shows as an example a case in which the impeller 491 is disposed in the air supply duct 33 (a case in which the impeller 491 is located at the rear of the heat-emitter).

The evaporator 41 is implemented as a plurality of metal plates arranged along a width direction (a Y-axis direction) of the connection duct 35 or a plurality of metal plates arranged along a height direction (a Z-axis direction) of the connection duct. The condenser 43 may be implemented as a plurality of metal plates arranged along a width direction of the connection duct or a height direction of the connection duct. The evaporator 41 and the condenser 43 are sequentially arranged in the connection duct 35 in a direction from the air discharge duct 31 toward the air supply duct 33, and are connected to each other via a refrigerant pipe 48 which defines a circulating flow passage of a refrigerant (see FIG. 4).

The refrigerant moves along a refrigerant pipe 48 by a compressor 45 located outside the circulating flow passage 3. The refrigerant pipe 48 is equipped with a pressure regulator 47 that controls a pressure of the refrigerant that has passed through the heat-emitter 43.

The evaporator 41 may cool the air and evaporate the refrigerant by delivering the heat of the air flowing into the air discharge duct 31 to the refrigerant. The condenser 43 may heat the air and condense the refrigerant by delivering the heat of the refrigerant passing through the compressor 45 to the air. In this case, moisture contained in the air may be collected on a bottom surface of the connection duct 35 along a surface of the evaporator 41 as the air passes through the evaporator 41.

A water collector is disposed in the laundry treating apparatus 100 to collect the water removed from the air passing through the evaporator 41.

The water collected in the water collector may be collected in the water storage 7 and then be collectively discharged later. The water storage 7 may include a storage body 72 detachably disposed in the cabinet 1 to define therein a space for storing the water therein, and an inlet 722 configured to penetrate the storage body 72 to introduce the water discharged from the water storage supply pipe 633 into the storage body 72.

The storage body 72 may be configured as a drawer-shaped tank extended from the cabinet 1. In this case, the front panel 11 of the cabinet must have a water storage mounting hole defined therein into which the storage body 72 is inserted. A panel 71 is fixed to the front surface of the storage body 72, and the panel 71 may be configured to be detachably coupled to the water storage mounting hole to form a portion of the front panel 11.

A groove 711 into which a user's hand is inserted may be further defined in the panel 71. In this case, the panel 71 will also perform a function of a handle of extending the storage body 72 from the cabinet or retracting the storage body 72 into the cabinet.

The inlet 722 may be defined to receive the water discharged from a nozzle 722*a* fixed to the cabinet 1. The nozzle 722*a* may be fixed to the top panel 13 of the cabinet to be positioned above the inlet 722 when the storage body 72 is inserted into the cabinet 1.

The water storage 7 having the above-described structure may discard the water inside the storage body 72 by overturning or inclining the storage body 72 in a direction in which the inlet 722 is located after the user extends the storage body 72 from the cabinet 1. A communication hole 721 configured to penetrate a top surface of the storage body 72 may be further defined such that the water inside the storage body 72 is easily discharged through the inlet 722.

The steam supplier 200 may be disposed to be spaced apart from the water storage 7. As described above, the steam supplier 200 may be configured to be connected to the internal water supplier 400 and an external water supplier 500 to receive the water to form the steam. The external water supplier 500 may include a direct water valve 520 adjacent to the rear panel 12 or fixed to the rear panel 12, and a direct water pipe 510 that supplies the water delivered from the direct water valve 520 to the steam supplier 200. The direct water valve 520 may be configured to be coupled to the external water supply source. For example, the direct water valve 520 may be coupled with a water supply pipe extending to the rear surface of the cabinet. Therefore, the steam supplier 200 may be configured to receive the water directly through the direct water valve 520. Therefore, even when the internal water supplier 400 is omitted, or when the water is not stored in the internal water supplier 400, the steam supplier 200 may receive the water through the direct water valve 520. The direct water valve 520 may be directly controlled by the steam controller 800.

In one example, the steam supplier 200 may be disposed adjacent to the direct water valve 520. Therefore, residual water may be prevented from remaining in the direct water pipe 510, and the water may be immediately supplied.

The internal water supplier 400 may include the water tank 420 for storing the water therein, the water pump 430 that may receive the water from the water tank 420 and supply the water to the steam supplier 200, and a tank housing 410 that defined therein a space for mounting the water tank 420 and the water pump 430 therein. The water pump 430 and the water tank 420 may be arranged at a vertical level corresponding to that of the steam supplier 200. The tank withdrawal hole 131 may be installed in a region of the top panel 13 corresponding to a portion where the water tank 420 is installed. Therefore, the water pump 430 may be prevented from being exposed through the tank withdrawal hole 131 as much as possible. The withdrawal cover 132 may be pivotably coupled to an outer circumferential surface of the tank withdrawal hole 131 to prevent the water tank 420 from being exposed to the outside.

The steam supplier 200 may receive the water through the water supplier 300 to generate the steam and then supply the water to the drum 2 or the duct 3 through the steam discharge pipe 213. The steam discharge pipe 213 may directly communicate with the drum 2 to supply the steam into the drum 2, and may communicate with the duct 3 or the second support 19 to indirectly supply the steam into the drum 2.

The steam discharge pipe 213 may be in communication with the air supply duct 33 when being connected to the duct 3, and may be in communication with the air inlet 198 when being connected to the second support 19. Therefore, the steam may be more smoothly introduced into the drum 2 using a power of the fan 49.

The steam supplier 200 may be controlled to generate the steam when a steam supply mode using the steam is performed during the drying process. The steam supply mode may correspond to a series of drying courses of sterilizing the laundry, increasing a temperature inside the drum during the drying process of the laundry, or removing wrinkles from the laundry at the end of the drying process of the laundry. The steam supplier 200 may be controlled to receive the water from the external water supplier 500 as well as the internal water supplier 400 to supply the steam into the drum 2 or the like.

In one example, the heat-exchanger 4 is configured to condense the moisture of the air circulating in the evaporator 41. Therefore, even when the air circulates in the drum 2, because the moisture contained therein is removed by the evaporator 41, the air may continuously dry the laundry inside the drum 2.

The moisture condensed in the evaporator 41 may be collected primarily in the water collector 37 and then secondly collected in the water storage 7. The water collector 37 may be located inside the connection duct 35 and may be separately disposed in a space spaced apart from the connection duct 35.

FIGS. 3 and 4 show an example in which the water collector 37 may be disposed inside the connection duct 35, but this is for illustration only. The water collector 37 may have any structure as long as the water collector 37 is able to collect the condensate.

FIG. 4 shows detailed structures of the water collector 37, the heat-exchanger 4, the washer 6, and the like.

The water collector 37 may be implemented as a water collector body 371 which is fixed to the bottom surface of the connection duct 35 and communicates with the inside of the connection duct. To prevent the heat-absorber and the heat-emitter 41 and 43 from contacting the water (condensate) stored in the water collector body 371, a heat-exchanger support 372 may be further disposed inside the water collector body 371. The heat-exchanger support 372 may include a support plate 373 which the heat-absorber and the heat-emitter 41 and 43 contact, a spacer 375 that maintains a spacing between the support plate 373 and the bottom surface of the water collector body 371, and a support plate through-hole 376 configured to pass through the support plate 373.

The support plate through-hole 376 may be defined only in a portion of the support plate 373 on which the evaporator 41 is supported, or may be defined in portions thereof on which the heat-absorber is supported and the heat-emitter is supported, respectively. When the support plate through-hole 376 is defined under the condenser 43, water that has flowed to the condenser 43 along the support plate 373 may be discharged to the water collector body 371 (thus, preventing decrease in heat transfer efficiency that occurs when the heat-emitter contacts the water).

In order to minimize accumulation of foreign matters (lint) discharged from the drum body 21 on the evaporator 41 and the condenser 43, a filtration unit for filtering air may be further disposed in the laundry treating apparatus 100. FIG. 3 shows a case in which the filtration unit is configured as a first filtration unit 5 disposed in the connection duct 35 and a second filtration unit 8 disposed in the air discharge duct 31 as an example.

The second filtration unit 8 may be configured to filter the air flowing into the air discharge duct 31 from the drum body 21, and the first filtration unit 5 may be disposed between the second filtration unit 8 and the heat-absorber 41 to filter the air that has passed through the second filtration unit. A diameter of a filtration hole defined in the first filtration unit 5 may be set smaller than a diameter of a filtration hole defined in the second filtration unit 8.

The second filtration unit 8 may include a frame 81 detachably inserted into the air discharge duct 31 through the air discharge hole 178, and a filter (a fourth filter) 83 disposed in the frame to filter the air.

The first filtration unit 5 may be detachably disposed in the connection duct 35. In this case, the front panel 11 of the cabinet may have a filter mounting hole 113 (see FIG. 1) through which the first filtration unit 5 is withdrawn and a mounting hole door 114 that opens and closes the filter mounting hole, and a duct through-hole 34 (see FIG. 3) into which the first filtration unit 5 is inserted may be defined in the duct 3. Accordingly, the user may remove foreign matters remaining in the first filtration unit 5 and wash the first filtration unit after separating the first filtration unit 5 from the laundry treating apparatus.

The first filtration unit 5 may be configured to include filtration unit body 51, 53, 57, and 58 inserted into the filter mounting hole 113 and the duct through-hole 34 and positioned between the second filtration unit 8 and the heat-absorber 41, and filters 531, 551, and 571 arranged in the filtration unit body to filter fluids (the air and the water) flowing to the evaporator 41 and the water collector body 371.

The filtration unit body may be in various shapes based on a shape of a cross-section (a Y-Z plane and an X-Z plane) of the connection duct 35. FIG. 1 shows a case in which the filtration unit body is in a shape similar to a hexahedron.

In this case, the filtration unit body may include a front surface 51 in a shape capable of closing the duct through-hole 34, a rear surface 53 positioned between the front surface and the evaporator 41, a bottom surface 55 configured to connect the front surface with the rear surface, and a first side surface 57 and a second side surface 58 respectively forming left and right surfaces of the filtration unit body.

The front surface 51 may have a lock 513 disposed thereon detachably coupled to a lock fastener 16 disposed on the cabinet. FIG. 1 shows as an example a case in which the lock 513 is configured as a bar pivotally coupled to the front surface 51 of the filtration unit body, and the lock fastener 16 is configured to define a groove in which a free end of the bar is received. For example, each lock 513 is disposed on each of opposite sides of the front surface 51, and each lock fastener 16 is disposed on each of opposite sides of the filter mounting hole 113.

A handle 511 may be further disposed on the front surface 51 to facilitate inserting the filtration unit body into the connection duct 35 or separating the filtration unit body from the connection duct 35.

A first filter 531 and a second filter 551 for filtering the fluids (the air and the water) introduced into the filtration unit body may be respectively arranged on the rear surface 53 and the bottom surface 55. The rear surface 53 has a rear surface through-hole defined therein that communicates an interior of the filtration unit body with an internal space of the duct 3, and the first filter 531 is disposed in the rear surface through-hole. The bottom surface 55 has a bottom surface through-hole defined therein that communicates the interior of the filtration unit body with the internal space of the duct 3, and the second filter 551 is disposed in the bottom surface through-hole. Therefore, the first filter 531 can filter the fluids (the air and the water) supplied to the evaporator 41, and the second filter 551 can filter the fluids supplied to the water collector body 371.

The first side surface 57 and the second side surface 58 may be configured to connect the front surface 51, the rear surface 53, and the bottom surface 55 with each other.

The first filtration unit 5 having the above-described structure may be configured to communicate with the air discharge duct 31 through the top surface or the second side surface 58 of the filtration unit body. FIG. 1 shows as an example a case in which the first filtration unit 5 is connected to the air discharge duct 31 through a top surface through-hole configured to penetrate the top surface of the filtration unit body and a side surface through-hole configured to penetrate the second side surface 58.

The first filter 531 may be configured to be inclined at 90 degrees to 100 degrees toward a front surface of the evaporator 41 with respect to the bottom surface 55 of the filtration unit body. This is to allow foreign matters remaining in the first filter to easily flow to the bottom surface 55 when the water is sprayed on the first filter 531 through a washer 6 to be described later.

The second filter 551 may be configured to be inclined downward by 10 to 20 degrees from the front surface 51 toward the first filter 531 (The second filter may be configured to be inclined upward by 10 to 20 degrees in a direction in which the filter mounting hole is located from a bottom of the first filter). When the second filter 551 is configured to be inclined downward toward the first filter 531, because a connection point of the first filter 531 and the second filter 551 will be the lowest point in the space defined in the first filtration unit, the foreign matters of the first filtration unit 5 may be concentrated at the connection point of the first filter 531 and the second filter 551. When the foreign matters are concentrated at the connection point of the first filter 531 and the second filter 551, the user will be able to more easily remove the foreign matters inside the first filtration unit 5.

However, when the foreign matters are concentrated at the connection point of the first filter 531 and the second filter 551, a long time may be required for the water sprayed through the washer 6 to be discharged to the collector body 371. In order to solve such problem, as shown in FIG. 1, the first side surface 57 may further include a bypass hole defined therein for communicating the interior of the first filtration unit 5 to the water collector body 371 and a third filter 571 disposed in the bypass hole. As shown in FIG. 3, the bypass hole and the third filter 571 may be located at a position higher than an uppermost end of the second filter 551 and lower than an uppermost end of the first filter 531. Accordingly, the laundry treating apparatus may minimize a phenomenon that the water sprayed to the first filtration unit 5 is not able to be re-collected into the water collector body 371 due to the foreign matters remaining in the first filtration unit 5.

In one example, the laundry treating apparatus 100 may further include the washer 6 that washes the first filtration unit 5 using the water stored in the water collector body 371. That is, the water stored in the water collector body 371 may be separately collected into the water storage 7 or may be selectively flowed to the washer 6.

The washer 6 may be configured to wash at least one of the first filter 531, the second filter 551, the third filter 571, and the heat-absorber 41 by spraying the water stored in the collector body 371 to the first filtration unit 5. The washer 6 may be configured to include a sprayer 65 disposed in the duct 3 to supply the water to the first filtration unit 5, and a washing pump 61 that flows the water stored in the collector body 371 to the sprayer 65.

The washing pump 61 may be connected to the water collector body 371 through a first connection pipe 611, and may be connected to the sprayer 65 through a second connection pipe 613. When the laundry treating apparatus is configured to flow the water of the water collector body 371 to the sprayer 65 and the water storage 7 with only one washing pump 61, the laundry treating apparatus 100 may further include a flow passage switcher 63. In this case, the flow passage switcher 63 may be configured to be connected to the washing pump 61 through the second connection pipe 613, the sprayer 65 may be configured to be connected to the flow passage switcher 63 through a sprayer supply pipe 631, and the water storage 7 may be configured to be connected to the flow passage switcher 63 through a water storage supply pipe 633.

In this case, the water storage supply pipe 633 must be configured to connect a nozzle 722*a* and the flow passage switcher 63 with each other.

The flow passage switcher 63 has a valve for controlling opening and closing of the sprayer supply pipe 631 and opening and closing of the water storage supply pipe 633. Accordingly, the laundry treating apparatus 100 may supply the water stored in the water collector body 371 to the sprayer 65 or to the water storage 7 by controlling the valve disposed on the flow passage switcher 63.

A case in which the sprayer 65 is configured to include a duct through-hole 651 defined therein to penetrate the connection duct 35 and connected to the sprayer supply pipe 631, a first guide 653 that guides the water supplied from the duct through-hole to the first filter 531, and a second guide 655 that guides at least a portion of the water supplied through the first guide 653 to the front surface of the evaporator 41 is shown as an example. In this case, the second guide 655 may be configured to supply the water to the front surface of the evaporator 41 through the first filter 531. That is, the first filter 531 may be configured to be positioned between the first guide 653 and the second guide 655 when the first filtration unit 5 is fixed to the connection duct 35, and the second guide 655 may be configured as an inclined surface inclined downward from a top surface of the connection duct 35 toward the first filter 531.

A guide through-hole 654 may be further defined in the first guide 653. The guide through-hole 654 is a hole configured to penetrate the first guide 653. The water introduced into the duct through-hole 651 may be supplied to a front region of the heat-absorber 41 through the guide through-hole 654. The front region of the heat-absorber refers to a region located in a direction facing toward the first filter 531 based on a vertical line passing through a center of the heat-absorber 41.

In one example, the laundry treating apparatus of the present disclosure can include a water collector water level sensor 91 that measures a level of the water in the collector body 371 and transmits the water level information to the controller. When the water collector water level sensor 91 is disposed, the laundry treating apparatus may determine a time point for flowing the water stored in the water collector body 371 to the storage body 72. Thus, the water in the water collector body 371 may be prevented from flowing back to the connection duct 35.

The water collector water level sensor 91 may be configured as any device capable of sensing the level of the water inside the water collector body 371. FIG. 3 shows a sensor with multiple electrodes having different lengths (with multiple electrodes electrically connected with each other based on the water level) as an example.

A dryness sensor may be disposed in the laundry treating apparatus 100 so as to determine a time point for stopping an operation of the heat-exchanger 4 by determining dryness of the laundry. The dryness sensor may be configured as at least one of an electrode sensor 95 configured to be in contact with the laundry to measure an amount of moisture contained in the laundry, and a humidity sensor that measures humidity of the air flowing from the drum 2 to the duct 3.

The electrode sensor may be configured to include a first electrode 951 and a second electrode 953 which may be fixed to the first fixed body 171 and contact the laundry in the drum body 21. Because the dryness increases, the amount of moisture contained in the laundry will decrease (an electrical resistance of the laundry increases), the laundry treating apparatus 100 may determine the dryness of the laundry by observing the electrical resistance measured when the two electrodes 951 and 953 are connected to each other through the laundry. In one example, as the dryness of the laundry increases, the amount of moisture contained in the air flowing into the circulating flow passage 3 will decrease, so that the laundry treating apparatus 100 may determine the dryness of the laundry by observing the humidity of the air introduced into the circulating flow passage 3 through the humidity sensor.

In addition, the laundry treating apparatus 100 may further include a temperature sensor 96 that measures a temperature of the air flowed into the duct 3. The temperature sensor 96 may be configured to be fixed to a top surface of the connection duct 35 and be positioned between the first filter 531 and the second filter 551.

Figure 5:
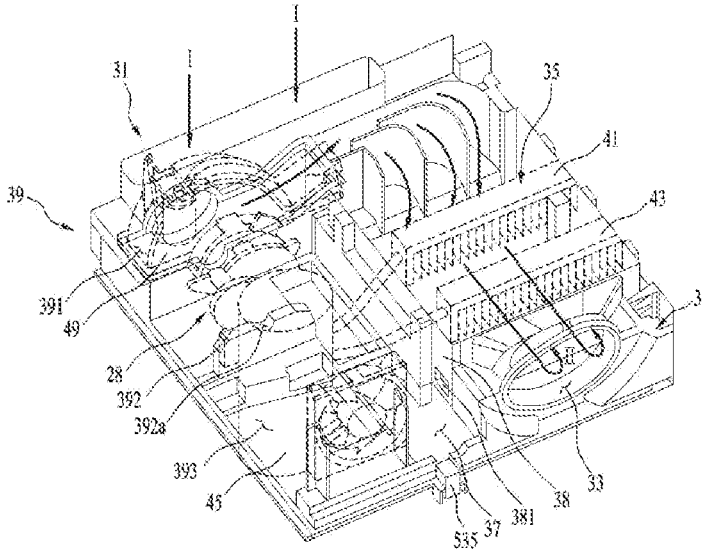
FIG. 5 shows an example of a duct structure of the laundry treating apparatus.
Figure 5:
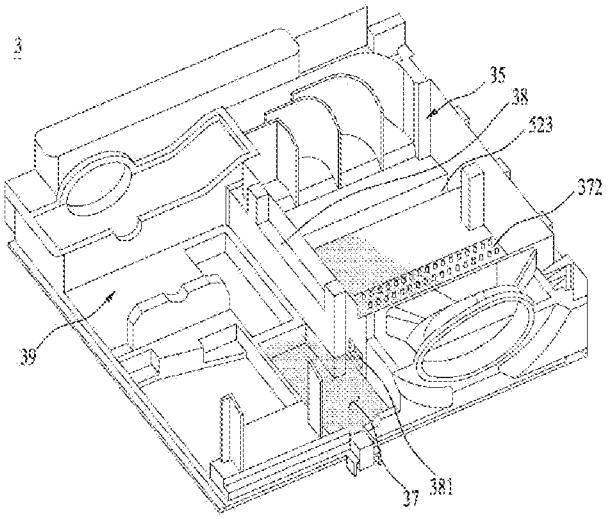

FIG. 5 shows an example including the connection duct 35 and the water collector 37 arranged on the bottom surface of the laundry treating apparatus of the present disclosure.

Referring to (a) in FIG. 5, the laundry treating apparatus of the present disclosure may further include a base 39 that defines the duct 3 and on which the hew-exchanger 4 may be installed.

A portion of the air discharge duct 31 may be installed on the base 39, and the air discharge duct 31 and the air supply duct 33 may be respectively installed at both ends of the connection duct 35.

The evaporator 41 and the condenser 43 may be installed in the connection duct 35.

The base 39 may include an apparatus installation portion 392 in which an apparatus such as a compressor and the like may be installed on one side of the connection duct 35.

The apparatus installation portion 392 may include a compressor installation portion 393 in which the compressor 45 may be installed, a fan installation portion 391 in which a blower fan may be seated, and a driver installation portion 392*a* in which a driver may be installed.

In one example, the water collector 37 may be further disposed in the apparatus installation portion 392. The water collector 37 may not be disposed beneath the connection duct 35, but may be separated by a partition wall 38 and disposed at one side of the connection duct 35.

Referring to (b) in FIG. 5, the connection duct 35 may include a heat-absorber mounting portion 372 in which the heat-absorber 41 may be installed, and a heat-emitter mounting portion 523 in which the heat-emitter may be mounted.

As the drying process proceeds, when the heat-exchanger is driven, the air passing through the evaporator 41 is cooled and the moisture contained therein is condensed. When the moisture is condensed, water may accumulate in the vicinity of the heat-absorber mounting portion 372 as shown.

A vertical level of a bottom surface of the connection duct 35 may decrease toward the water collector 37. The partition wall 38 may be configured to block the air flowing along the connection duct 35 from flowing to the apparatus installation portion 392, but may include a communication hole 381 defined therein to allow the condensed water to flow to the water collector 37.

The water condensed to the communication hole 381 may flow to the water collector 37 and be collected in the water collector 37. The washing pump 61 may be installed in the water collector 37. For example, the water collector 37 may further include a pump fixing portion 535 in which the washing pump 61 is seated and fixed. The pump fixing portion 535 may be configured to space a bottom surface of the washing pump 61 and the water collector 37 from each other by a predetermined distance.

Therefore, when sufficient water is collected in the water collector 37, the water may be removed by driving the washing pump 61. The flow passage switcher 63 may be controlled to spray the supplied water to the sprayer 65 or to flow the supplied water to the water storage 7.

In one example, a flow direction of the air may be set differently depending on driving of the fan. In this case, the air discharge duct 31 may function as the air supply duct 33, and the air supply duct 33 may function as the air discharge duct 31. In addition, positions of the evaporator 41 and the condenser 43 may be changed.

Figure 6:
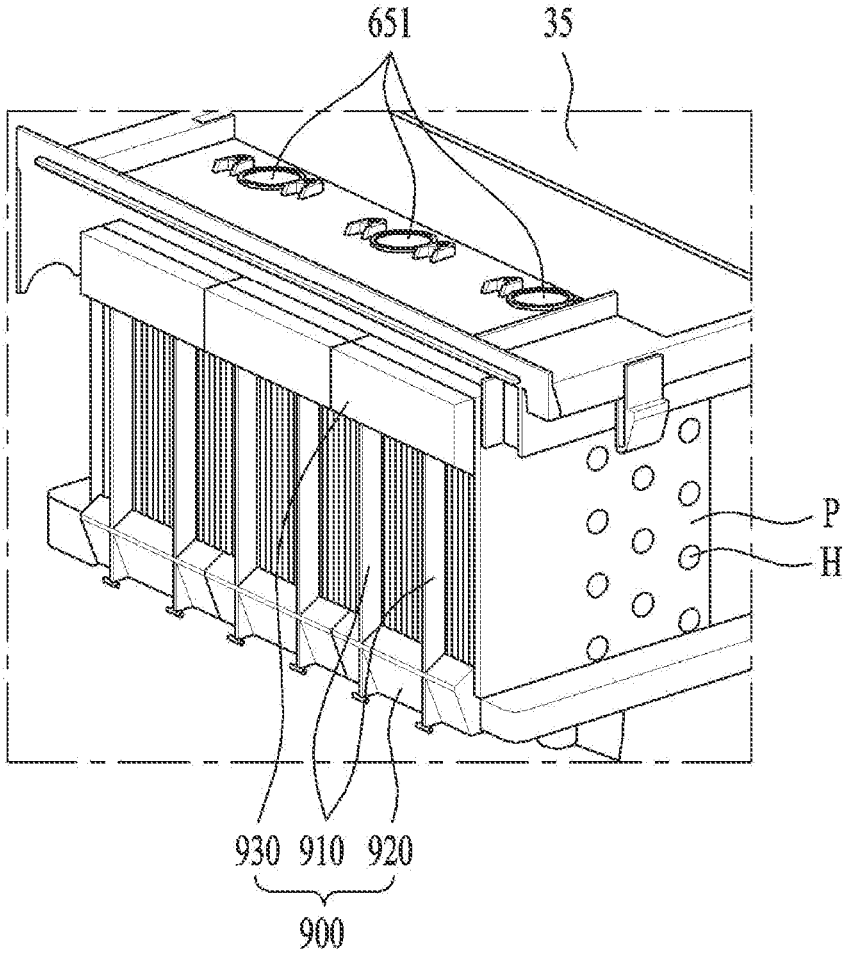
FIG. 6 shows an example of a removal device installed on an evaporator of the laundry treating apparatus.

FIG. 6 shows the heat-exchanger 4 of the laundry treating apparatus.

As described above, the heat-exchanger 4 may include the evaporator 41 installed inside the duct 3 or the circulating flow passage to cool the air discharged from the drum 2, and the condenser 43 disposed to be spaced apart from the evaporator to heart the air that has passed through the evaporator 41.

Each of the evaporator 41 and the condenser 43 may include a plurality of heat exchange fins P. The heat exchange fins P may be made of a metal material having high thermal conductivity, and may be formed in a plate shape. The plurality of heat exchange fins P may have a front surface or a rear surface disposed perpendicular to a direction in which the air flows. That is, one surface corresponding to a thickness of the plurality of heat exchange fins P may be disposed in a direction in which the air is introduced. The plurality of heat exchange fins P may be disposed to be spaced apart from each other. Accordingly, the air discharged from the drum may flow between the plurality of heat exchange fins P.

The plurality of heat exchange fins P may have a plurality of refrigerant holes H defined therein to support the refrigerant pipe. The heat exchange fins P of the evaporator 41 may support a low-temperature refrigerant pipe discharged from the expansion valve, and the heat exchange fins P of the condenser 43 may support a high-temperature refrigerant pipe discharged from the compressor.

Accordingly, the heat exchange fins P of the evaporator 41 may be cooled by the refrigerant pipe to cool the air flowing between the heat exchange fins P, and the heat exchange fins P of the condenser 43 may be heated by the refrigerant pipe to heat the air flowing between the heat exchange fins P.

In one example, the foreign matters such as the lint and the like discharged from the drum may collide with a portion of the heat exchange tins P facing the inflow surface through which air is introduced. In this connection, because a spacing between the heat exchange fins P is small, the foreign matters may not pass through the heat exchange fins P, and a large amount of the foreign matters may be attached to the inflow surface, which is an upstream portion of the heat exchange fins P.

In particular, because the evaporator 41 is located upstream of the condenser 43, the foreign matters may be more easily attached to the evaporator 41 than the condenser 43.

The foreign matters attached to the evaporator 41 or the condenser 43 may interfere with the flow of air discharged from the drum, thereby reducing the drying efficiency. Furthermore, when the foreign matters are corrupted by moisture and the like, the foreign matters may contaminate the laundry accommodated inside the drum 2.

Accordingly, the laundry treating apparatus may further include a removal device 900 capable of removing the foreign matters attached to the evaporator 41 or the condenser 43. In addition, the removal device 900 may be installed in the first filtration unit 5 to remove the foreign matters attached to the first filtration unit 5.

Hereinafter, an example in which the removal device 900 removes the foreign matters attached to the evaporator 41 will be described. However, this is only for description, and does not exclude that the removal device 900 is also applied to the condenser 43 or the first filtration unit 5.

The removal device 900 may be configured to be detachably disposed on the surface of the evaporator 41 to separate the foreign matters attached to the evaporator 41 by applying a mechanical force. Accordingly, the removal device 900 may separate the foreign matters remaining even when water is supplied to the evaporator 41 from the evaporator 41. In addition, the removal device 900 may separate the foreign matters attached to the evaporator 41 even when water is not supplied to the evaporator 41.

The removal device 900 may be disposed on the inflow surface through which air is introduced into the evaporator 41. That is, the removal device 900 may be disposed on one surface facing upstream of the heat exchange fins P of the evaporator 41. Accordingly, the foreign matters attached to the inflow surface of the evaporator 41 may be effectively removed.

The removal device 900 may include a separating body 910 disposed on one surface of the evaporator 41 or the condenser 43, and a seated portion 930 that receives a force that separates the separating body 910 from the duct 3 or the circulating flow passage.

The separating body 910 may be disposed on the inflow surface of the evaporator 41, and may be disposed to be spaced apart from the inflow surface of the evaporator 41. When the separating body 910 is disposed to be spaced apart from the inflow surface of the evaporator 41, the separating body 910 will be spaced apart from the inflow surface of the evaporator 41 toward an upstream of the circulating flow passage.

Accordingly, the separating body 910 may separate the foreign matters from the evaporator 41.

The separating body 910 may be disposed to be inserted between the heat exchange fins P, may be disposed on the surface of the heat exchange fins P, and may be disposed to be spaced apart from the inflow surface of the heat exchange fins P by a predetermined distance. That is, the separating body 910 may be disposed anywhere of the heat exchange fins P as long as being able to separate the foreign matters of the heat exchange tins P.

In one example, the separating body 910 may be formed in a shape of a plate or a rod directed in a height direction of the heat exchange fins P. The separating body 910 may have a portion corresponding to a thickness thereof thin like a blade, and the portion corresponding to the thickness may be disposed such that a cross-section thereof faces the upstream of the circulating flow passage 3.

In other words, the separating body 910 may be formed as the plate, and the portion thereof corresponding to the thickness rather than a portion corresponding to a width or a length may be disposed to face the upstream of the circulating flow passage. Accordingly, it is possible to minimize interference of the separating body 910 with the flow of the air flowing into the evaporator 41. The separating body 910 may separate the foreign matters on the surface of the evaporator 41 while minimizing the interference with the flow of the air flowing into the evaporator 41.

In addition, the separating body 910 may have a height equal to or greater than a height of the heat exchange fins P. Accordingly, it is possible to remove all foreign matters attached to the heat exchange fins P.

In addition, the separating body 910 may include a plurality of separating bodies spaced apart from each other along a width direction of the evaporator 41. Accordingly, the plurality of separating bodies 910 may remove most foreign matters attached to the inflow surface of the evaporator 41.

The seated portion 930 may be coupled to the separating body 910 to dispose the separating body 910 on the surface of the evaporator 41. The seated portion 930 may fix the separating body 910 such that the separating body 910 is inserted into the inflow surface of the evaporator 41 or disposed on a front surface of the inflow surface of the evaporator 41.

The seated portion 930 may be coupled to all of the plurality of separating bodies 910 to temporarily fix the plurality of separating bodies 910 to the surface of the evaporator 41. The seated portion 930 may be coupled to one end of the separating body 910 to be away from the heat exchange fins P. Accordingly, as the seated portion 930 is away from the heat exchange fins P, the separating body 910 may be spaced apart from the surface of the evaporator 41.

In one example, when the separating body 910 is spaced apart from the surface of the evaporator 41, the foreign matters attached to the evaporator 41 may be removed. However, when the separating body 910 continues to be spaced apart from the evaporator 41, foreign matters attached again to the evaporator 41 are not able to be removed. Therefore, a position of the separating body 910 needs to be restored even when the separating body 910 is spaced apart from the evaporator 41.

In some implementations, the removal device 900 may further include a driver 940 capable of separating the separating body 910 from the evaporator 41 to the circulating flow passage and moving the separating body 910 back to the evaporator 41.

The driver 940 may be configured to reciprocate the separating body 910 from the inflow surface of the evaporator 41 toward the circulating flow passage.

The driver 940 may be configured to be coupled to the seated portion 930 to reciprocate the separating body 910 by separating the seated portion 930 from the evaporator 41 or moving the seated portion 930 back to the evaporator 41.

The driver 940 may be in any shape and structure as long as the driver 910 is able to separate at least one of the seated portion 930 and the separating body 910 from the inflow surface of the evaporator 41 or restore a position of the at least one of the seated portion 930 and the separating body 910 again.

For example, the driver 940 may be configured such that the position of the separating body 910 is restored again after linearly moving the separating body 910 from the inflow surface of the evaporator 41 toward the upstream of the circulating flow passage, and restoring one end of the separating body 910 again after pivoting said one end of the separating body 910 to be away from the evaporator 41.

When the driver 940 is configured to pivot the separating body 910, the removal device 900 may further include a pivoting portion 920 coupled to the separating body 910 to pivotably support the separating body 910.

The pivoting portion 920 may be configured to be spaced apart from the seated portion 930 and coupled to the separating body 910. When the seated portion 930 is coupled to said one end of the separating body 910, the pivoting portion 920 may be disposed to be coupled to the other end of the separating body 910. As a result, the seated portion 930 and the pivoting portion 920 may support the separating body 910 to be placed at a proper position.

In addition, the pivoting portion 920 may be configured to support the plurality of separating bodies 910 together with the seated portion 930.

The seated portion 930 may be coupled to an upper end of the separating body 910, and the pivoting portion 920 may be coupled to a lower end of the separating body 910. In one example, the seated portion 930 may be coupled to the lower end of the separating body 910, the pivoting portion 920 may be coupled to the upper end of the separating body 910.

The driver 940 may be configured to provide power to pivot the pivoting portion 920.

Accordingly, when the pivoting portion 920 pivots at a lower end or a lower portion of the evaporator 41, the separating body 910 may be separated or spaced apart from the surface of the evaporator 41, and the foreign matters attached to the surface of the evaporator 41 may be removed.

In addition, when the pivoting portion 920 pivots oppositely at the lower end or the lower portion of the evaporator 41, the separating body 910 may come close to the surface of the evaporator 41 again.

The pivoting portion 920 may be pivotably coupled to the duct 3, or may be pivotably coupled to a member to which the heat exchange fins P are fixed at the lower end of the evaporator 41.

The driver 940 may be provided as a motor that directly pivots the pivoting portion 920. Alternatively, the driver 940 may be configured to be coupled to the seated portion 930 and push or pull the seated portion 930 to indirectly pivot the pivoting portion 920.

For example, when water is supplied to the duct through-hole 651, the water may be supplied to the inflow surface of the evaporator 41 to remove the foreign matters attached to the surface of the evaporator 41. In this connection, the driver 940 may be configured to communicate the duct through-hole 651 with the seated portion 930.

When water is supplied to the duct through-hole 651, the water may flow to the seated portion 930 through the driver 940. In this process, the driver 940 may be configured to space the seated portion 930 apart from the evaporator 41. In addition, the driver 940 may be configured to approach the seated portion 930 back to the evaporator 41 when the water supply to the driver 940 is stopped.

Accordingly, the driver 940 may reciprocate the seated portion 930 to be closer to or farther from the evaporator 41 passively by the water supplied to the driver 940 even when the driver 940 is not provided as a separate motor, an actuator, or the like.

In other words, the driver 940 may push the seated portion 930 with the water supplied from the washer 6 to separate the separating body 910 from the evaporator 41 while pivoting the pivoting portion 920.

In addition, the driver 940 may be configured such that a restoring force acts when the water supply to the washer 6 is stopped, thereby pulling the seated portion 930 to pivot the pivoting portion 920 in an opposite direction, and approaching the separating body 910 to the evaporator 41.

As a result, it is possible to prevent the driver 940 from being provided as a separate energy-consuming electronic product.

Figure 7:
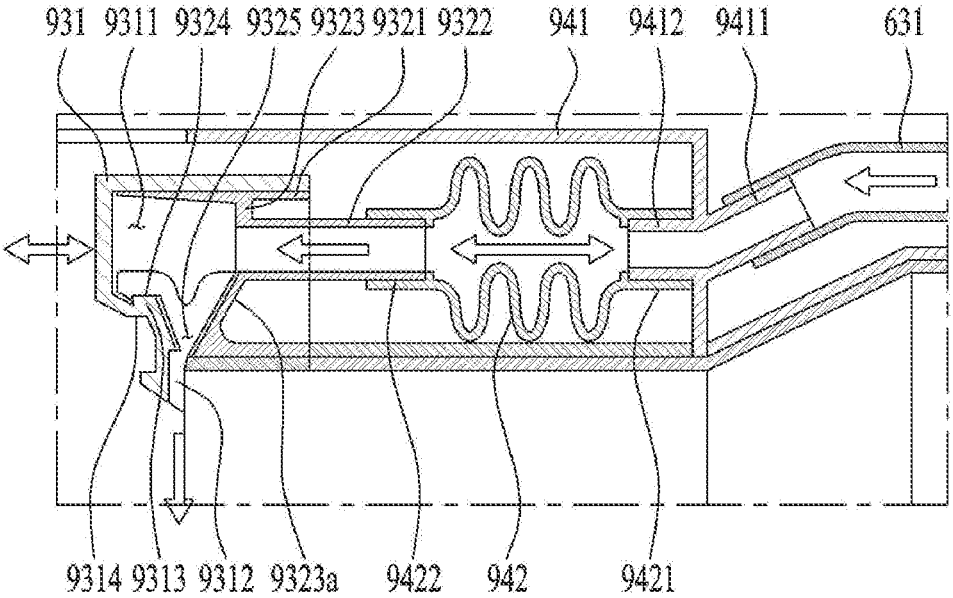
FIG. 7 shows an operation process of the removal device.

FIG. 7 shows an example of the driver 940.

The driver 940 may be configured to be coupled to the seated portion 930 to push or pull the seated portion 930.

The driver 940 may be configured to receive water from the washer 6 acid push the seated portion 930 with the water.

The driver 940 may include a mounting duct 341 mounted on a top surface of the duct 3 or on an upper end of the evaporator 41. The mounting duct 341 may have therein a space through which water may flow.

At least a portion of the seated portion 930 may be accommodated in the mounting duct 341. Accordingly, the seated portion 930 may be placed on the evaporator 41 by being accommodated in the mounting duct 341.

One surface of the mounting duct 341 facing an upper portion of the circulating flow passage 3 may be opened, so that at least a portion of the seated portion 930 may be accommodated or withdrawn therethrough.

A suction pipe 9411 coupled to the sprayer supply pipe 631 to receive water may extend from the other surface of the mounting duct 341 facing the seated portion 930.

The suction pipe 9411 may be configured to protrude from the mounting duct 41 and may be detachably coupled to the sprayer supply pipe 631.

In one example, the mounting duct 341 may include an extended pipe 9412 extending inward from the other surface of the mounting duct 341 to receive water supplied to the suction pipe 9411. The extended pipe 9412 may be configured to be in communication with the suction pipe 9411 and may be configured to extend toward said one surface.

The driver 940 may further include an elastic pipe 942 disposed inside the mounting duct 341. The elastic pipe 942 may be configured to have a variable length and disposed inside the mounting duct 341.

The elastic pipe 942 may be configured such that one end thereof is coupled to the extended pipe 9412 and the other end thereof is coupled to the seated portion 930, and may be in a shape of a corrugated pipe made of an elastic material.

Accordingly, when water is introduced into the elastic pipe 942, a wrinkle of the elastic pipe 942 may be expanded by a pressure or a self-load of the water. Accordingly, the elastic pipe 942 may be configured to push the seated portion 930 to the outside of the mounting duct 341.

In one example, when the water supply into the elastic pipe 942 is stopped, the elastic pipe 942 is restored to an original state thereof by a restoring force. Accordingly, the elastic pipe 942 may be shortened in length and pull the seated portion 930 to the mounting duct 341.

The seated portion 930 may include an inflow body 932 coupled to one end of the elastic pipe 942 to receive water, and a seated body 931 coupled to the separating body 910 to supply water supplied from the inflow body 932 to the separating body 910 or the evaporator 41.

The seated body 931 may be disposed to be seated on the upper end of the evaporator 41. At least a portion of the seated body 931 may be accommodated in the mounting duct 941 and may be inserted into and withdrawn from the mounting duct 941 through an open surface of the mounting duct 941.

The inflow body 932 may be configured to receive water from the elastic pipe 942 and deliver the water to the seated body 931. The inflow body 932 may include a support duct 9321 that may be fixed to the seated body 931, and an inflow pipe 9322 that may extend from the support duct 9321 and may be coupled to the elastic pipe 942.

The support duct 9321 may be formed in a shape corresponding to an inner surface of the seated body 931, and may be coupled to the inner surface of the seated body 931 in a force-fitting manner.

The support duct 9321 may have a dividing wall 9323 for partitioning an interior and an exterior of the seated body 931 to prevent escape of water introduced into the seated body 931, and the inflow pipe 9322 may extend from one surface of the partition wall 9323.

The dividing wall 9323 may be disposed to be spaced apart from the inner surface of the seated body 931. The dividing wall 9323 may be disposed to define a space between the seated body 931 and the support duct 9321.

The inflow pipe 9322 may be coupled to the elastic pipe 942 to supply water to the space between the support duct 9321 and the seated body 931. When the length of the elastic pipe 942 is extended, the inflow pipe 9322 may push the support duct 9321 to separate the seated body 931 from the mounting duct 341.

In one example, a portion of the dividing wall 9323 disposed on the inflow pipe 9322 may extend vertically from an inner surface of the support duct 9321. However, in order to induce the water introduced from the inflow pipe 9322 to be supplied to a surface of the separating body 910, a portion of the dividing wall 9323 disposed beneath the inflow pipe

9322 may be formed as an inclined surface 9323*a* inclined toward the separating body 910.

The seated portion 930 may further include an outlet hole 9325 defined therein capable of supplying water supplied through the inflow pipe 9322 to the separating body 910 or the evaporator 41.

A diameter of the outlet hole 9325 may be smaller than a diameter of the inflow pipe 9322. Accordingly, the water flowed into the inflow pipe 9322 may be prevented from being discharged directly to the outlet hole 9325, and the water may be sufficiently stored in the seated portion 930 and supplied by being uniformly distributed over an entirety of the outlet hole 9325.

A direction of the water introduced into the inflow pipe 9322 and a direction of the water discharged from the outlet hole 9325 may be different from each other. Accordingly, the water supplied through the inflow pipe 9322 may be evenly spread inside the seated portion 930 while flowing along the inner surface of the seated portion 930 and then discharged through the outlet hole 9325. As a result, the water may be prevented from being discharged in a state of being concentrated in a specific portion of the outlet hole 9325, so that water may be discharged to a wider region.

The outlet hole 9325 may be defined in a lower portion of the seated portion 930, and may be located above the separating body 910. The water supplied to the inflow pipe 9322 may be temporarily stored in the seated body 931 and the support duct 9321 and then supplied to the outlet hole 9325.

The seated body 931 may have an accommodating groove 9311 that is defined to accommodate the support duct 9321 therein and may temporarily store water therein. The seated body 931 may have an open portion in which the inflow pipe 9322 is disposed.

The seated body 931 may further include a discharge hole 9312 extending from the outlet hole 9325 to guide water to the separating body 910. The discharge hole 9312 may extend from the lower portion of the seated body 931 such that the water discharged from the outlet hole 9325 may flow while being concentrated along a longitudinal direction of the separating body 910.

In order to facilitate production of the seated portion 930, the seated body 931 and the inflow body 932 may be detachably coupled to each other. For example, the inflow body 932 may include a coupling hook 9324 that extends from the support duct 9321 or the dividing wall 9323 to be away from the inflow pipe 9322, and the seated body 931 may have a coupling step 9313 to which the coupling hook 9324 may be detachably coupled to formed on an inner circumferential surface of the accommodating groove 9311.

Accordingly, even when water is supplied between the seated body 931 and the inflow body 932, or even when the inflow body 932 reciprocates by the elastic pipe 942, relative positions of the seated body 931 and the inflow body 932 may be fixed while a coupled state therebetween is maintained.

The elastic pipe 942 may include a first pipe 9421 coupled to the extended pipe 9412, an elastic body 9422 configured to have a variable diameter in the first pipe and made of an elastic material, and a second pipe 9423 extending from the elastic pipe 942 and coupled to the inflow pipe 9322.

The elastic body 9422 may be configured to be stretched or contracted such that a spacing between the first pipe 9421 and the second pipe 9423 may be varied.

When water is introduced into the first pipe 9421 through the sprayer supply pipe 631 and supplied to the elastic body 9422, the water may generate a frictional force on the elastic body 9422 to push the elastic body 9422 toward the seated body 931. In this connection, because the first pipe 9421 is fixed to the extended pipe 9412, the elastic body 9422 may extend while pushing the second pipe 9423.

When the second pipe 9423 is extended, the inflow pipe 9322 is pushed out to withdraw the seated body 931 from the mounting duct 941.

When water is introduced into the second pipe 9423, the water may be stored inside the support duct 9321 and the seated body 931 through the inflow pipe 9322. When a diameter of the inflow pipe 9322 is smaller than that of the outlet hole 9325, as water is stored between the seated body 931 and the dividing wall 9323, water may be evenly distributed in the accommodating groove 9311. Accordingly, water may be uniformly discharged to the separating body 910 through the entirety of the outlet hole 9325.

Figure 8:
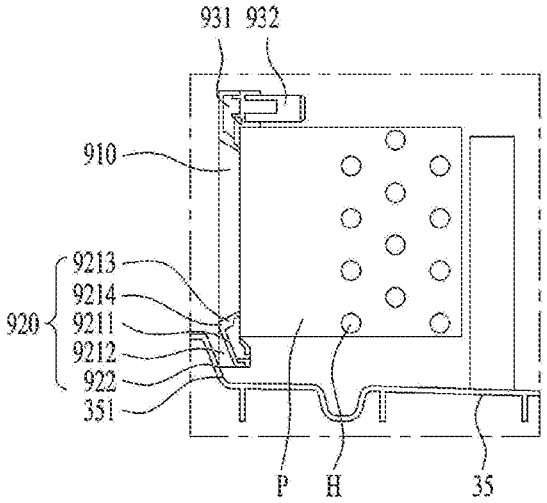
FIG. 8 is a cross-sectional view of FIG. 7.
Figure 8:
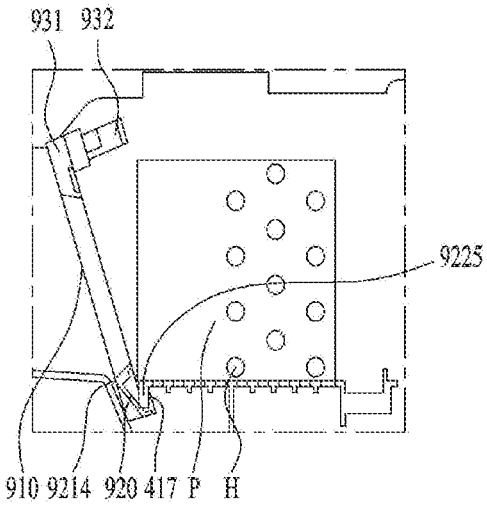

FIG. 8 shows a structure of the pivoting portion 920 capable of pivoting the separating body.

The pivoting portion 920 may include a pivoting body 921 coupled to the lower end of the separating body 910, and a pivoting link 922 for pivotably supporting the pivoting body 921 on one surface of the evaporator 41 or the circulating flow passage 3.

Referring to (a) in FIG. 8, the pivoting link 922 may be configured to be pivotably supported by the circulating flow passage 3.

The circulating flow passage 3 may include a pivoting duct 351 connected from the correction duct 35 to the air discharge duct 31 to support the rotation link 922.

The pivoting duct 351 may be configured to extend from the connection duct 35 to be inclined upward. The pivoting link 922 may be configured to pivot while being supported by the pivoting duct 351, and may be pivotably coupled to and fixed to the pivoting duct 351.

The pivoting body 921 may include a body holder 9212 coupled to the separating body 910 and pivoting about the pivoting link 922, and a holder support 9214 disposed on the body holder 9212 to limit a pivoting angle of the separating body.

The body holder 9212 may be configured to support the plurality of separating bodies 910, and pivot the plurality of separating bodies 910.

The holder support 9214 may extend toward the circulating flow passage 3 or the pivoting duct 351 from one surface of the body holder 9212. When the body holder 9212 pivots at a certain angle or more, the holder support 9214 may come into contact with the pivoting duct 351 to prevent excessive pivoting of the body holder 9212.

The body holder 9212 may be configured to accommodate therein the lower end of the separating body 910. The pivoting body 921 may include a first support 9211 that extends from a side surface of the body holder 9212 to reinforce a thickness of the pivoting body 921.

The pivoting body 921 may be configured to support the plurality of separating bodies 910, and may have a plurality of body holders 9212 formed therein. In this connection, the plurality of body holders 9212 may be spaced apart from each other by a distance corresponding to a spacing between the separating bodies 910, and each first support 9211 may be disposed between a pair of the plurality of body holders 9212.

The first support 9211 may have a slope extending upward from a lower portion of the pivoting body 921 to the circulating flow passage 3 to increase a pivoting force of the pivoting body 921. A second support 9213 extending upward toward the evaporator 41 may be further disposed at an upper end of the first support 9211.

The holder support 9214 may be disposed at a portion where the first support 9211 and the second support 9213 are connected to each other.

The seated body 931 may be coupled to a top of the separating body 910. The seated body 931 is coupled to the inflow body 932.

Referring to (b) in FIG. 8, when the inflow body 932 moves the seated body 931 toward the circulating flow passage 3 by the driver 940, the pivoting link 922 may be pivoted to pivot the pivoting body 921. In this connection, the separating body 910 may be spaced apart from the evaporator 41 by pivoting about the pivoting link 922.

When the holder support 9214 comes into contact with the pivoting duct 351, the pivoting body 921 may be prevented from further pivoting.

In one example, the pivoting link 922 may include a link coupling portion 9225 that is pivotably coupled to a lower end of the evaporator 41. In this connection, there is no problem even when the pivoting link 922 is not supported by or in contact with the circulating flow passage 3 or the pivoting duct 351.

Figure 9:
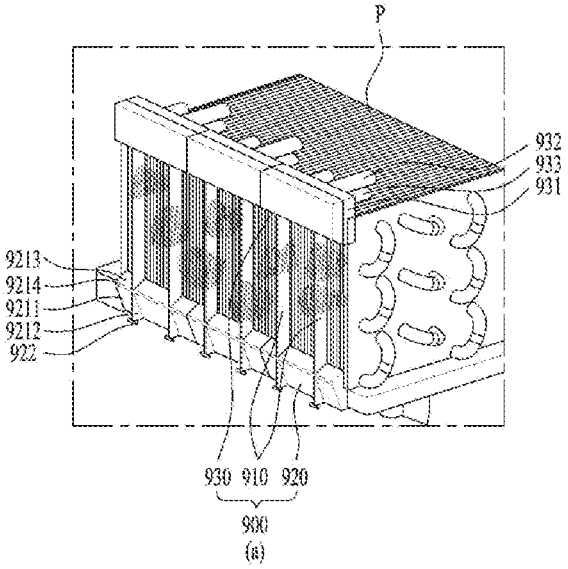
FIG. 9 shows an example in which the removal device is configured to be detached from or re-attached to the evaporator.
Figure 9:
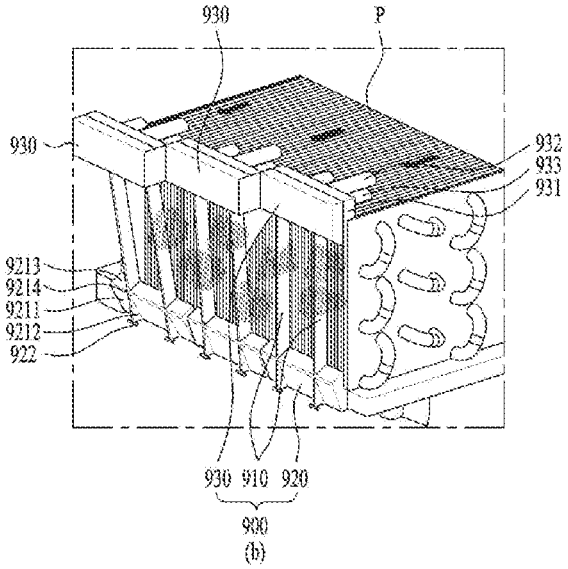

The pivoting link 922 may be pivotably coupled to the lower end of the evaporator 41, and the pivoting body 921 may pivot about the pivoting link 922, FIG. 9 shows an aspect of an operation of the removal device 900.

Referring to (a) in FIG. 9, the seated portion 930 and the pivoting portion 920 may pivotably support the plurality of separating bodies 910. The seated portion 930 and the pivoting portion 920 may have the same width and may be configured to support the same number of separating bodies 910.

The pivoting portion 920 may have the pivoting link 922, and the pivoting link 922 may be disposed at a lower end of the body holder 9212 supporting the lower end of the separating body 910.

The body holder 9212 mays have a shape the same as a shape of the lower end of the separating body 910. However, the number of body holders 9212 and the spacing between the body holders 9212 may correspond to the number of separating bodies 910 and the spacing between the separating bodies 910. The first support 9211 that supports the body holder 9212 and the second support 9213 that extends upward from the first support 9211 may be disposed between adjacent two body holders 9212.

The first support 9211 may be formed in a shape with a small thickness at a lower end and a large thickness at an upper end so as to induce the pivoting of the pivoting body 921.

The second support 9213 may have a slope extending upward from the first support 9211 toward the evaporator 41 to reinforce rigidity of the pivoting body 921, guide the air discharged from the drum to the evaporator 41, and separate the foreign matters that have come down from the separating body 910.

When the first support 9211 extends upwardly to be away from the evaporator 41, the second support 9213 may be viewed as extending upwardly so as to be closer to the evaporator 41.

In this connection, the seated portion 930 may have a width corresponding to that of the pivoting portion 920, and may have a plurality of seated portions. This is for increasing a force to separate a specific seated portion 930 from the evaporator 41 by disposing the specific seated portion 930 to correspond to a portion of the inflow surface of the evaporator 41, and supplying the water supplied from the washer 6 to the specific seated portion 930 in a concentrated manner.

The plurality of seated portions 930 may be disposed along a width direction of the evaporator 41, and may receive water from the washer 6 sequentially.

The seated portion 930 may further include balance bodies 933 respectively extending in left and right directions of the inflow body 932 from not only the sealed body 931, but also the inflow body 932. Through the balance bodies 933, the seated portion 930 may be prevented from moving while being twisted.

Referring to (b) in FIG. 9, a large amount of foreign matters fray be attached to the inflow surface of the evaporator 41.

When the drying process is completed or a command to wash the evaporator 41 is input, the specific seated portion 930 may be spaced apart from the evaporator 41 through the driver 940.

For example, water may be supplied to the specific seated portion 930 of the plurality of seated portions 930 through the driver 940. Accordingly, as the length of the elastic pipe 942 coupled to the specific seated portion 930 is extended, a specific pivoting portion 920 corresponding to the specific seated portion 930 may be pivoted while the specific seated portion 930 moves away from the evaporator 41.

At least one separating body 910 coupled to the specific seated portion 930 and the specific pivoting portion 920 at the same time may be separated or spaced apart from the inflow surface of the evaporator 41, and the foreign matters attached to an outer surface of the separating body 910 may be separated from the evaporator 41.

Furthermore, the specific seated portion 930 may supply water to the separating body 910. Accordingly, the water supplied to the separating body 910 may flow to the specific pivoting portion 920 along a longitudinal direction of the separating body 910, and the specific pivoting portion 920 may completely escape downward of the evaporator 41 by the second support 9213.

Accordingly, the foreign matters attached to a portion of the inflow surface of the evaporator 41 corresponding to the specific seated portion 930 and the specific pivoting portion 920 may be removed.

Thereafter, when the supply of water to the specific seated portion 930 is stopped, the driver 940 may restore a position of the specific seated portion 930.

At the same time, while water is supplied to another seated portion 930, the above-described process may be performed in the same manner. Accordingly, foreign matters attached to a portion of the inflow surface of the evaporator 41 corresponding to another seated portion 930 may be removed.

In addition, water may be supplied to another seated portion 930, and the above-described process may proceed.

As a result, all foreign matters attached to the inflow surface of the evaporator 41 may be separated by the separating body 910 and may be separated downwardly of the evaporator 41.

The separated foreign matters may be collected in the water storage 7 through the washing pump 61 together with the condensate.

The plurality of seated portions 930 may be supplied with water in an ascending order of a distance to the washer 6. Accordingly, the foreign matters attached to the inflow surface of the evaporator 41 may be continuously removed.

However, it may be controlled that the water is supplied to all seated portions 930 at the same time, unlike shown. In addition, there may be one seated portion 930 having a width corresponding to the width of the inflow surface of the evaporator 41, and thus, there may be one pivoting portion 920 having a width corresponding to the width of the inflow surface.

The present disclosure may be modified and implemented in various forms. Thus, the scope of the present disclosure is not limited to the above-described implementation. Therefore, when the modified implementation includes the component of the claims of the present disclosure, the modified implementation should be viewed as belonging to the scope of the present disclosure.

The invention claimed is:

1. A laundry treating apparatus comprising:

a cabinet that defines an outer appearance of the laundry treating apparatus;

a drum accommodated in the cabinet and configured to receive laundry therein;

a circulating flow passage configured to supply air discharged from the drum into the drum;

a fan disposed inside the circulating flow passage and configured to cause the air to flow along the circulation flow passage;

a heat-exchanger including (i) an evaporator disposed inside the circulating flow passage and configured to cool the air discharged from the drum and (ii) a condenser spaced apart from the evaporator and configured to heat the air in the circulating flow passage; and a removal device coupled to the evaporator or the condenser, the removal device being configured to move relative to the heat-exchanger to thereby separate foreign matters from the evaporator or the condenser, wherein each of the evaporator and the condenser includes a plurality of heat exchange fins, wherein the removal device includes:

a separating body disposed at one side of the evaporator or the condenser, the separating body being disposed between heat exchange fins among the plurality of heat exchange fins of the evaporator or the condenser, a driver configured to move the separating body toward and away from the circulating flow passage, and a pivoting portion that is coupled to the separating body and pivotably supports the separating body, and wherein the driver is configured to rotate the pivoting portion to thereby rotate the separating body between the heat exchange fins and separate the foreign matters from the heat exchange fins.

2. The laundry treating apparatus of claim 1, wherein the separating body is disposed at a surface of the evaporator facing an upstream side of the circulating flow passage.

3. The laundry treating apparatus of claim 1, wherein the evaporator is configured to contact the air guided by the circulating flow passage before the condenser contacts the air, and wherein the separating body is disposed at a surface of the evaporator.

4. The laundry treating apparatus of claim 1, wherein the removal device further comprises a seated portion spaced apart from the pivoting portion and coupled to the separating body, and wherein the driver is coupled to the seated portion and configured to push or pull the seated portion.

5. The laundry treating apparatus of claim 4, further comprising a washer configured to supply water to a surface of the evaporator to thereby remove the foreign matters from the evaporator, and wherein the driver is configured to receive the water from the washer and to push the seated portion by the water.

6. The laundry treating apparatus of claim 5, wherein the seated portion is configured to remove the foreign matters by the water that is received from the driver and transferred to the separating body or the surface of the evaporator.

7. The laundry treating apparatus of claim 5, wherein the seated portion includes:

an inflow body coupled to the driver and configured to receive water from the driver; and a seated body coupled to the separating body and configured to supply the water from the inflow body to the separating body or the surface of the evaporator.

8. The laundry treating apparatus of claim 7, wherein the driver includes an elastic pipe that fluidly communicates the washer and the inflow body with each other, and wherein the elastic pipe is configured to:

push the inflow body based on water being supplied from the washer, and pull the inflow body based on water supply from the washer being stopped.

9. The laundry treating apparatus of claim 8, wherein the driver includes:

a mounting duct fixed to the evaporator;

a suction pipe that extends from the mounting duct and is coupled to the washer; and an extended pipe that is disposed inside the mounting duct and in fluid communication with the suction pipe, the extended pipe being coupled to the elastic pipe.

10. The laundry treating apparatus of claim 4, wherein the pivoting portion is coupled to a first end of the separating body, wherein the seated portion is disposed at a second end of the separating body.

11. The laundry treating apparatus of claim 10, wherein the pivoting portion is one of a plurality of pivoting portions that are disposed along a surface of the evaporator, and wherein the driver is configured to sequentially rotate the plurality of pivoting portions.

12. The laundry treating apparatus of claim 1, wherein the pivoting portion includes:

a pivoting body coupled to an end of the separating body; and a pivoting link that pivotably supports the pivoting body on a surface of the evaporator or the circulating flow passage.

13. The laundry treating apparatus of claim 12, wherein the pivoting body includes:

a body holder coupled to the separating body; and a holder support disposed at the body holder and configured to limit a pivoting angle of the separating body.

14. The laundry treating apparatus of claim 1, wherein the removal device is coupled to the evaporator and configured to move relative to the evaporator to separate the foreign matters from the evaporator.

15. The laundry treating apparatus of claim 14, wherein the removal device is configured to rotate relative to the evaporator.

16. The laundry treating apparatus of claim 14, wherein the removal device is configured to linearly move relative to the evaporator.

17. The laundry treating apparatus of claim 1, wherein the removal device is coupled to the condenser and configured to move relative to the condenser to separate the foreign matters from the condenser.

18. The laundry treating apparatus of claim 17, wherein the removal device is configured to rotate relative to the condenser or linearly move relative to the condenser.

19. The laundry treating apparatus of claim 1, wherein the separating body is configured to rotate relative to the one side of the evaporator or the condenser.

20. The laundry treating apparatus of claim 1, wherein the separating body is configured to move into and out of an internal space defined between opposing surfaces of the heat exchange fins.

* * * * *